US006723003B1

(12) United States Patent
Harrell

(10) Patent No.: US 6,723,003 B1
(45) Date of Patent: Apr. 20, 2004

(54) GOLF STANCE COORDINATOR TEMPLATE AND METHOD FOR USING THE SAME

(76) Inventor: Stephen R. Harrell, 4165 Harrell Rd., Rockledge, FL (US) 32955

( * ) Notice: Subject to any disclaimer, the term of this patent is extended or adjusted under 35 U.S.C. 154(b) by 0 days.

(21) Appl. No.: 10/201,039

(22) Filed: Jul. 23, 2002

(51) Int. Cl.[7] ..... A63B 53/06; A63B 53/16; A63B 69/36

(52) U.S. Cl. ..... 473/270; 473/266

(58) Field of Search ..... 473/261, 263, 473/265, 266, 268, 257, 210, 264, 277, 258, 270, 271, 272, 273, 452; 482/15, 16, 17, 35; 33/289, 508; D21/791, 792, 789, 793

(56) References Cited

U.S. PATENT DOCUMENTS

| | | | | | |
|---|---|---|---|---|---|
| 3,229,981 | A | * | 1/1966 | Taber | 473/272 |
| 3,300,219 | A | * | 1/1967 | Sipos | 473/218 |
| 4,257,608 | A | * | 3/1981 | Funk | 473/272 |
| 4,538,815 | A | | 9/1985 | Poirer | |
| 4,544,161 | A | * | 10/1985 | Guendling, Jr. | 473/270 |
| 4,784,393 | A | * | 11/1988 | Williams et al. | 473/272 |
| 4,993,716 | A | | 2/1991 | Waller | |
| 5,108,106 | A | | 4/1992 | Cook | |
| 5,255,921 | A | * | 10/1993 | Spence | 473/218 |
| 5,322,288 | A | * | 6/1994 | Amis | 473/272 |
| 5,362,060 | A | * | 11/1994 | Hinson | 473/218 |
| 5,549,298 | A | | 8/1996 | Cullen et al. | |
| 5,599,240 | A | | 2/1997 | Feldmeier | |
| 5,616,085 | A | * | 4/1997 | LaCoste et al. | 473/267 |
| 5,730,659 | A | | 3/1998 | Morita | |
| 5,893,805 | A | * | 4/1999 | Douglass | 473/218 |
| 5,944,613 | A | | 8/1999 | Dubois | |
| 6,106,408 | A | | 8/2000 | Roman | |
| 6,142,883 | A | | 11/2000 | Ferrara | |
| D437,910 | S | | 2/2001 | Bobo | |

* cited by examiner

*Primary Examiner*—Gregory Vidovich
*Assistant Examiner*—Alvin A. Hunter, Jr.
(74) *Attorney, Agent, or Firm*—John D. Gugliotta; P. Jeff Martin; Olen L. York, III

(57) ABSTRACT

A golf stance coordinator template and method for using the same is provided for establishing and documenting a correct stance and for repeated positioning of the golf ball when utilizing assorted golf clubs. The device includes a foot positioning template having an E-shaped configuration when assembled for use. The foot positioning template includes first, second, and third vertical foot marker members which are pivotally secured to a horizontal foot marker member. The foot positioning template folds into an I-shaped configuration for ease in transportability. Indicia are provided to serve as golf stance indicator markers.

19 Claims, 4 Drawing Sheets

GOLF STANCE COORDINATOR TEMPLATE AND METHOD FOR USING THE SAME

RELATED APPLICATIONS

The present invention was first described in Disclosure Document No. 498,947 filed on Aug. 23, 2001. There are no previously filed, nor currently any co-pending applications, anywhere in the world.

BACKGROUND OF THE INVENTION

1. Field of the Invention

The present invention relates generally to golf training aids and, more particularly, to a foldable golf stance coordinator template and method for using the same.

2. Description of the Related Art

Numerous golf training devices have been provided for training a golfer in various intricacies of the game including head and shoulder alignment, club swing, correct body motion during swing, club grip, club-face angle, and the like. However, proper stance is the foremost essential step for executing proper golf shots, and repeating such stance has been a long felt problem faced by most if not all golfers.

Accordingly, there is a need for a means by which to establish a correct stance and for positioning the golf ball in a repetitive manner when utilizing assorted golf clubs such that various types of golf shots can be properly aligned in a manner which is quick, easy, and effective. The development of the foldable golf stance coordinator template and method for using the same fulfills this need.

A search of the prior art did not disclose any patents that read directly on the claims of the instant invention; however, the following references were considered related.

U.S. Pat. No. 6,142,883, issued in the name of Ferrara, discloses a golf stance alignment training device.

U.S. Pat. No. D437,910, issued in the name of Bobo, discloses a golf stance and swing training aid.

U.S. Pat. No. 5,730,659, issued in the name Morita, discloses a golf stance correcting device.

U.S. Pat. No. 5,549,298, issued in the name of Cullen et al., discloses a golf alignment apparatus.

U.S. Pat. No. 5,599,240, issued in the name of Feldmeier, discloses a golf training device.

U.S. Pat. No. 5,944,613, issued in the name of Dubois, discloses a golf stance and ball alignment practice aid.

U.S. Pat. No. 6,106,408, issued in the name of Roman, discloses a golf stance training device.

U.S. Pat. No. 5,108,106, issued in the name of Cook, discloses a golf alignment template.

U.S. Pat. No. 4,993,716, issued in the name of Waller, discloses a golf stance alignment device.

U.S. Pat. No. 4,538,815, issued in the name of Poirer, discloses a golf stance gauge.

Consequently, a need has been felt for a device which facilitates correct stance and positioning of the golf ball in a repetitive manner when utilizing assorted golf clubs such that various types of golf shots can be properly executed.

SUMMARY OF THE INVENTION

Therefore, it is an object of the present invention to provide a foldable golf stance coordinator template for establishing a correct stance and for positioning the golf ball when utilizing assorted golf clubs such that various types of golf shots can be properly aligned.

It is another object of the present invention to provide a device being easily foldable so as to allow for easy storage by the template within a golf bag or similar portable container, thus facilitating transportability.

It is still another object of the present invention to provide a horizontal foot marker member with indicia disposed thereon.

It is still another object of the present invention to provide vertical foot marker members pivotally attached to the horizontal foot marker member, and having indicia disposed thereon.

It is another object of the present invention to provide a ball positioning member attached by a hinge to the horizontal foot marker member.

It is another object of the present invention to provide a ball positioning member which defines an arcuate-shaped, tee-receiving notch at an end thereof for accommodating a golf tee.

It is another object of the present invention to provide the horizontal foot marker member and vertical foot marker members with indicia for plotting and recording proper feet positioning.

It is another object of the present invention to provide a plurality of holes for the insertion of tees or similar anchoring means to hold the present invention in place during use.

It is another object of the present invention to provide a method of use for establishing a correct stance and positioning of the golf ball when utilizing assorted golf clubs such that golf shots can be properly executed.

Briefly described according to one embodiment of the present invention, a foldable golf stance coordinator template and method for using the same is provided for establishing and documenting a correct stance and for repeated positioning of the golf ball when utilizing assorted golf clubs such that various types of golf shots can be properly aligned. The present invention is designed and configured so as to accommodate golfers of different height, thus being tailor-made to each individual golfer.

The device comprises a foot positioning template having an E-shaped configuration when assembled for use. The foot positioning template includes first, second, and third vertical foot marker members, wherein each are pivotally secured to a horizontal foot marker member via a locking assembly. Each foot marker member is designed and configured so as to pivotally collapse inward in a direction towards the horizontal foot marker member, thus folding into an I-shaped shaped configuration. The I-shaped configuration allows for easy storage by the template within a golf bag or similar portable container, thus facilitating transportability.

Hingedly attached via a hinge to the upper end of the third vertical foot marker member is a ball positioning member. The ball positioning member defines an arcuate-shaped, tee-receiving notch at an end thereof for accommodating a golf tee. The hinge allows the ball positioning member to be folded atop or superimposed over the third vertical foot marker member in a flush manner.

Indicia are provided along a lower surface of the ball positioning member, and is represented as a series of letters.

Horizontally disposed indicia are displayed along an upper surface of the horizontal foot marker member. The horizontally disposed indicia are shown represented as a first series of numerals.

Vertically disposed indicia are displayed along an upper surface of both the first and second vertical foot marker member. The vertically disposed indicia are represented as a series of letters. Holes are provided for the insertion of tees or similar anchoring means to hold the present invention in place during use and to mark current stance coordinates.

In order to properly use the present invention, a user selects a golf club, determines the best foot position for the chosen club, and documents such coordinates. User determines proper stance or feet position via the horizontally and vertically disposed indicia. Once proper stance is found, user plots and documents such coordinates in order that such stance can be repeated.

The use of the present invention allows a user to determine a point of reference for feet position, relative to golf ball position and club choice for properly executing various golf shots.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
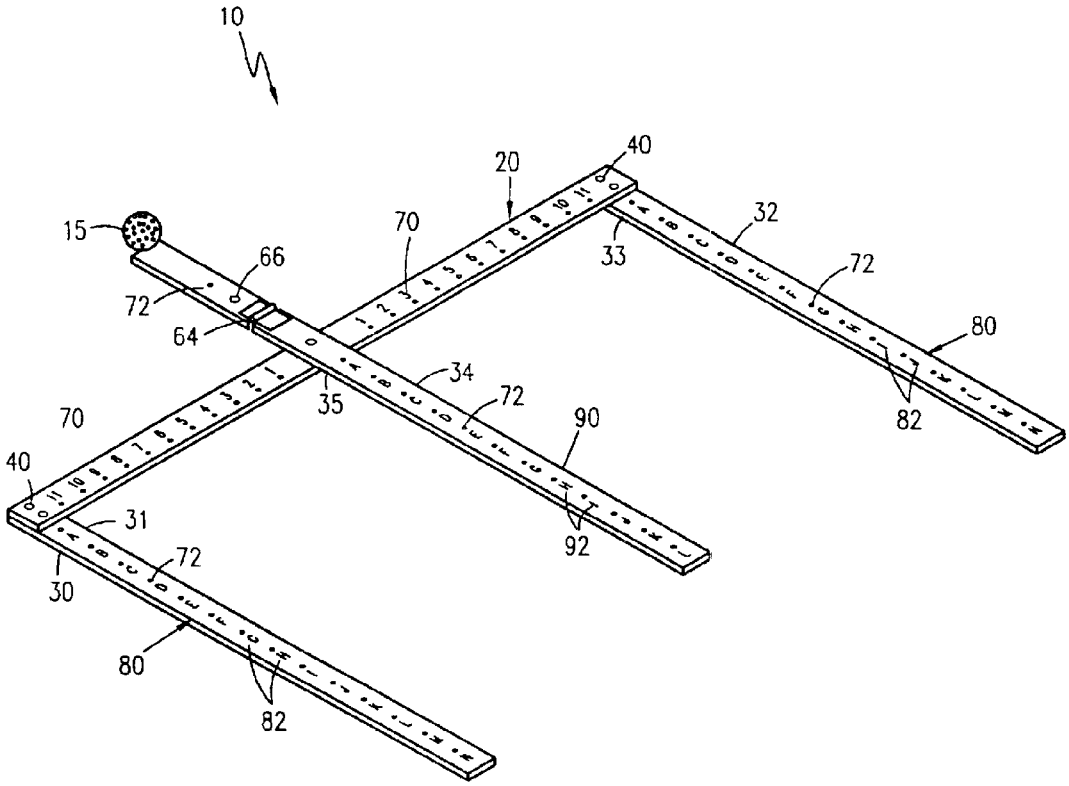
FIG. 1 is a perspective view of a foldable golf stance coordinator template according to the preferred embodiment of the present invention.

Referring now to FIGS. 1–6, a foldable golf stance coordinator template and method for using the same 10 is shown, according to the present invention, comprised of a foot positioning template 20 having an E-shaped configuration when assembled for use. For illustrative purposes, the foldable golf stance coordinator template and method for using the same 10, hereinafter referred to as template 10, is shown in the following figures as assembled for utilization by a right-hand golfer 18; however, rotation of the present invention 180° configures such device for a left-hand golfer. The present invention is additionally configured for both lateral and longitudinal placement of golfer's feet 18*a* with respect to the golf ball 15, according to chosen club 50, i.e., iron or wood.

Further, the template 10 aids in establishing a correct stance and in positioning the golf ball 15 when utilizing assorted golf clubs 50 such that various types of golf shots can be properly aligned.

Moreover, the template 10 is designed and configured so as to accommodate golfers 18 of different height, thus being tailor-made to each individual golfer 18.

The foot positioning template 20 includes a horizontal foot marker member 22 of an elongated rectangular, planar configuration. Pivotally secured at one end of a lower surface of horizontal foot marker member 22 and extending perpendicularly therefrom is a first vertical foot marker member 30 of an elongated, rectangular, planar configuration.

Pivotally secured at an opposite end of the lower surface of horizontal foot marker member 22 and extending perpendicularly therefrom is a second vertical foot marker member 32 of an elongated, rectangular, planar configuration.

A third vertical foot marker member 34 is pivotally secured along a linearly elongated centerline to an upper surface of horizontal foot marker member 22 and extends perpendicularly therefrom in a manner so as to traverse the horizontal foot marker member 22. The third vertical foot marker member 34 is of an elongated, rectangular planar configuration and has an upper end 34*b* projecting outward, slightly beyond a width of the horizontal foot marker member 22. The third vertical foot marker member 34 is designed with a shorter length with respect to the first and second vertical foot marker members 30, 32.

Figure 3:
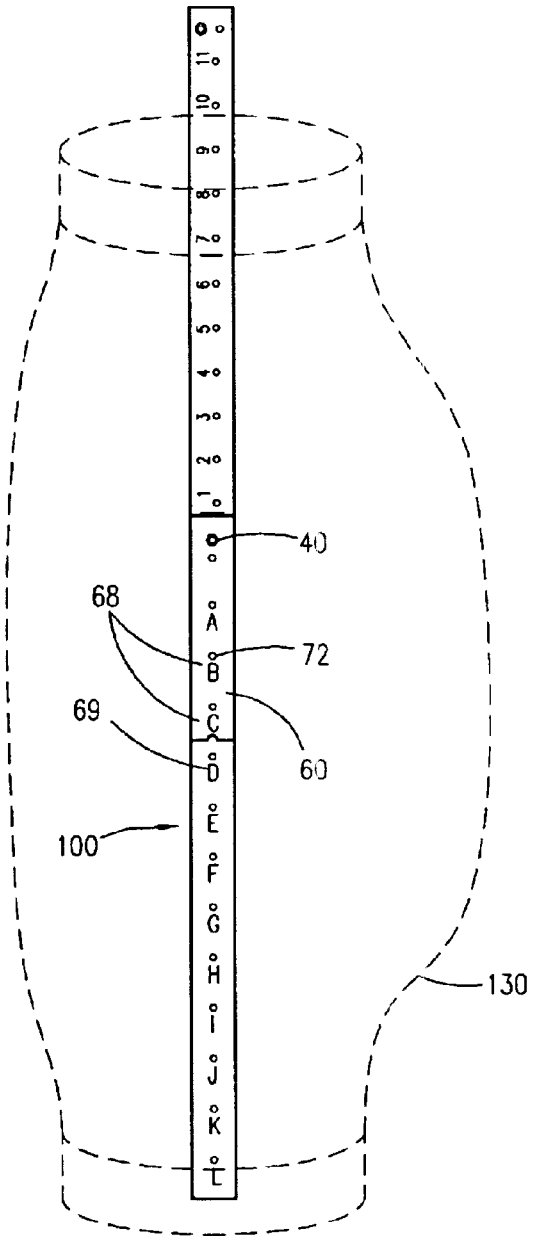
FIG. 3 is a top plan view of the present invention according to the preferred embodiment shown folded in an I-shaped configuration within a golf bag.
Figure 4:
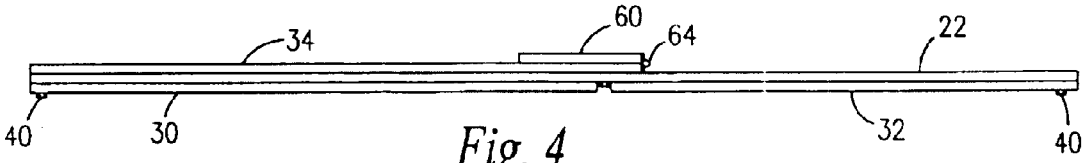
FIG. 4 is a side elevational view of the present invention according to the preferred embodiment shown folded in an I-shaped configuration.
Figure 5:
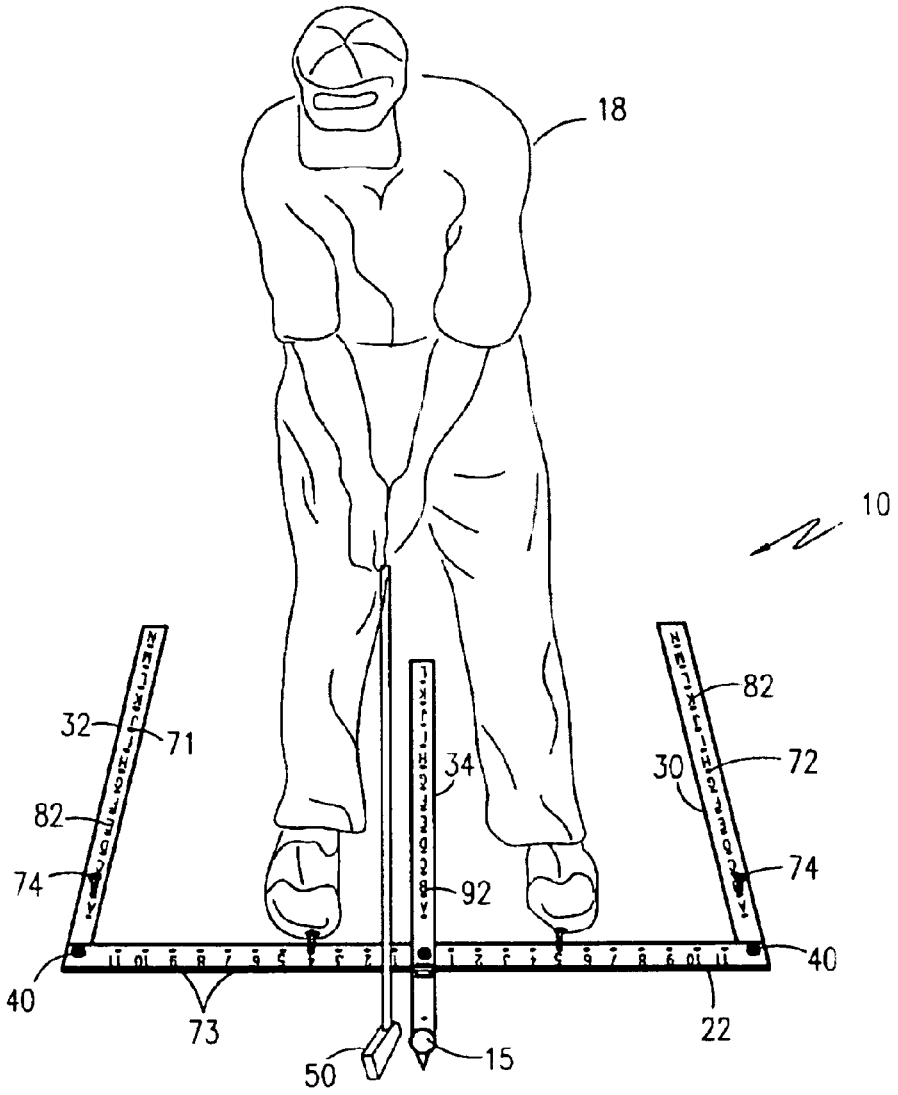
FIG. 5 is a perspective view of the present invention according to the preferred embodiment shown in-use.
Figure 6:
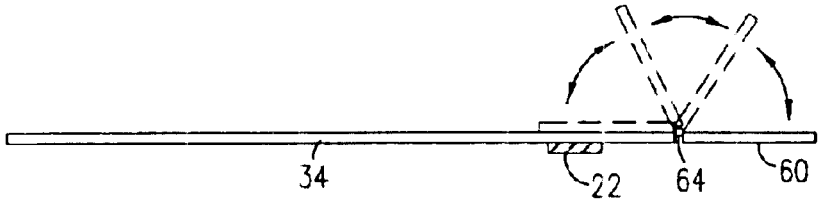
FIG. 6 is a side elevational view of the ball positioning member showing its travel path when folded atop the third vertical foot marker member.

The first, second, and third vertical foot marker members 30, 32, 34 are each secured to the horizontal foot marker member 22 via a locking assembly 40. The locking assembly 40 is comprised of a bolt, a washer, and a nut, wherein each nut being torqued so as to allow for each foot marker member 30, 32, 34 to freely pivot about the horizontal marker member 22. It is envisioned that each foot marker member 30, 32, 34 is designed and configured so as to pivotally collapse inward in a direction towards the horizontal foot marker member 22, as depicted by direction arrows 30*a*, 32*a*, and 34*a*, respectively, thus folding into an I-shaped configuration 100 as shown in FIGS. 3–4. The I-shaped configuration 100 allows for easy storage by the template 10 within a golf bag or similar portable container, thus facilitating transportability.

Hingedly attached via a hinge 64 to the upper end 34*b* of the third vertical foot marker member 34 is a ball positioning member 60. The ball positioning member 60 defines an arcuate-shaped, tee-receiving notch 62 at an end thereof for accommodating a golf tee 74, wherein golf tee 74 is used to support a golf ball 15 there atop. The tee-receiving notch 62 serves as the ball-placement position from which proper alignment of golfer's feet 18*a* are gauged. The hinge 64 allows for the ball positioning member 60 to be folded atop the third vertical foot marker member 34 in a flush manner. An aperture 66 is provided above the hinge 64 so as to allow passage by the locking assembly 40 of the third vertical foot marker member 34.

Indicia 68 are provided along a lower surface of the ball positioning member 60, and is represented as a series of letters 69 starting with the letter "A" and ending with the letter "C". Holes 72 are provided directly above each letter. The indicia 68 are designed and configured such that when the ball positioning member 60 is superimposed over the third vertical foot marker member 34, the indicia 68 correspond in an identical manner with letters "A" through "C" (to be described in greater detail below) of the third vertical foot marker member 34.

Figure 2:
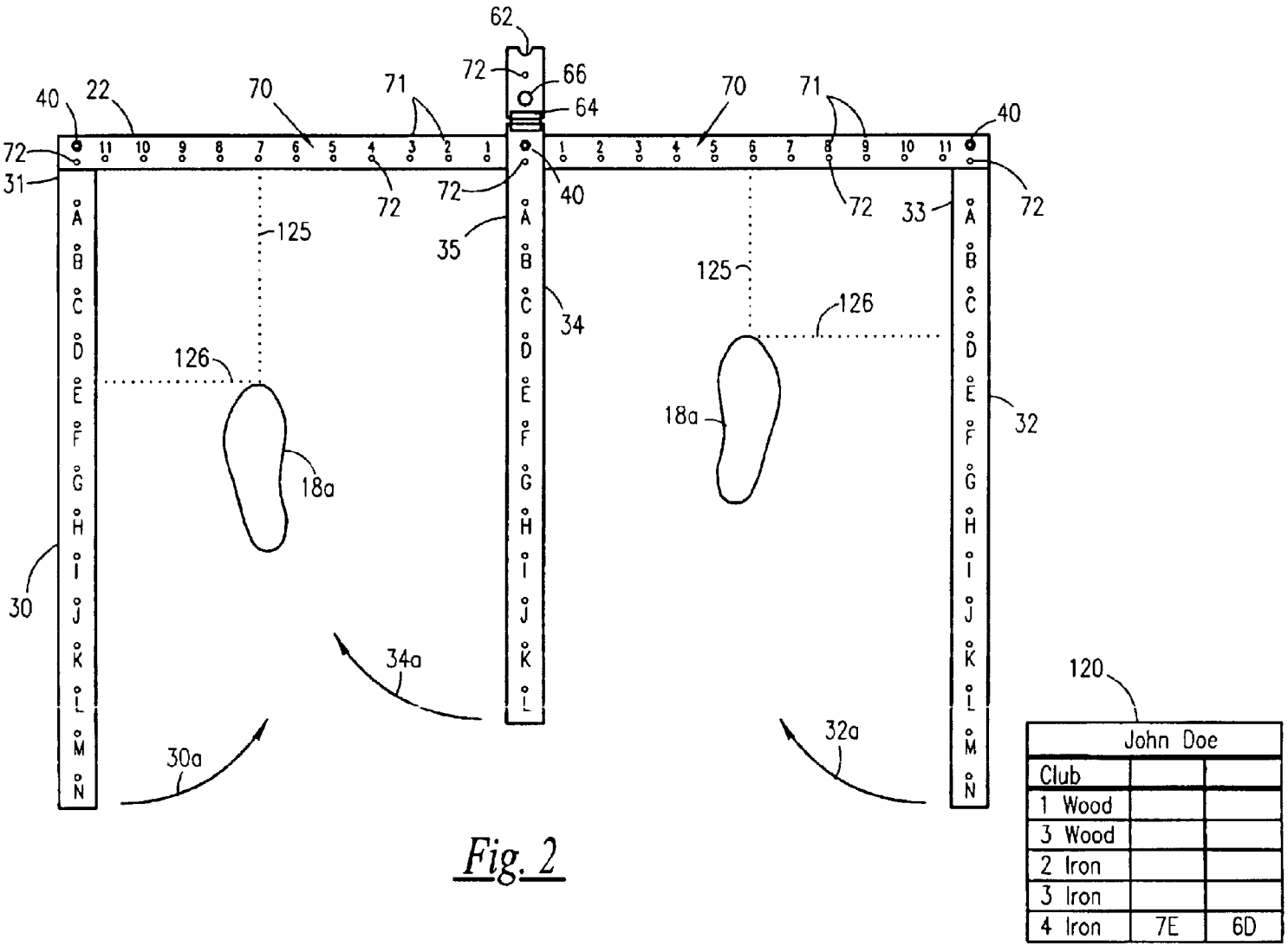
FIG. 2 is a top plan view thereof also showing a sample chart.

As shown in FIGS. 1 and 2, horizontally disposed indicia 70 are displayed along an upper surface of the horizontal foot marker member 22. The indicia 70 is shown represented as a first series 71 of numerals, starting with "11" and descending in consecutive order to "1". The indicia 70 are further represented by a second series 72 of numerals, starting with "1" and increasing in consecutive order to "11". Holes 72 are provided directly below each numeral for insertion of tees 74 or similar anchoring means to hold the present invention in place during use and to mark current stance coordinates. Holes 72 are also provided directly below each locking assembly 40 for insertably receiving tees 74, thereby further securing the template 10 in place.

Vertically disposed indicia 80 are displayed along an upper surface of both the first and second vertical foot marker member 30, 32. The indicia 80 are represented as a series of letters 82 beginning at a forward end 31, 33 of the first and second vertical foot marker member 30, 32, respectively, wherein the series of letters 82 start with the letter "A" and end with the letter "N".

Vertically disposed indicia 90 are also displayed along an upper surface of the third vertical foot marker member 34. The indicia 90 are represented by a series of letters 92 beginning at a forward end 35 of the third vertical foot marker member 34. The series of letters 92 start with the letter "A" and end with the letter "L". However, for purposes of this disclosure, the number of "letters" described herein being displayed on the first, second, and third vertical foot marker members 30, 32, 34 is meant merely as a suggestion, and is not intended to be a limiting factor. Holes 72 are provide directly above each letter for insertion of tees 74.

It is envisioned that indicia 68, 70, 80, 90 are each spaced approximately 2 inches apart.

Referring now to FIGS. 1–6, in order to establish the correct stance so as to facilitate properly aligned golf shots, the template 10 is pivotally unfolded from a stored I-shaped configuration 100 to the E-shaped configuration, and laid flat on the ground, parallel to an intended ball flight path. Specifically, the first, second, and third vertical foot marker members 30, 32, 34 are pivotally unfolded away from the horizontal foot marker member 22 so as to rest in perpendicular relation thereto. Tees 74 are inserted through various holes 72 selected by user so as to secure the present invention to the ground. After utilizing the tee-receiving notch 62 for placing the golf tee 74 in proper position, a golf ball 15 is placed there atop, and the ball positioning member 60 is folded atop the third vertical foot marker member 34 such that an upper surface of the ball positioning member 60 lies in a flush manner, flat against the upper surface of third vertical foot marker member 34. A golf club 50 of choice is then selected. User then determines the best foot position for the chosen club and the intended ball flight, and documents such coordinates. For illustrative purposes, a sample chart 120 is shown in FIG. 2 to represent the proper right and left foot 18*a* coordinates for a "4 iron". For example, when making a left foot coordinate determination, numerals "11" to "1" displayed on horizontal foot marker member 22 represent an X-axis 126, while letters "A" through "N" displayed on first vertical foot marker member 30 represent a Y-axis 125. Additionally, when making a right foot coordinate determination, numerals "1" through "11" displayed on horizontal foot marker member 22 represent the X-axis 126, while letters "A" through "N" displayed on second vertical foot marker member 32 represent the Y-axis 125. FIG. 2. illustrates coordinate "7,E" is plotted for proper left foot placement and coordinate "6,D" is plotted for proper right foot placement when utilizing a "4 iron". It should be noted that proper feet coordinates would vary with each individual user, thus the aforementioned example is meant merely for illustrative purposes only.

2. Operation of the Preferred Embodiment

To use the present invention, user pivotally unfolds the template 10 from a stored I-shaped configuration 100 to the E-shaped configuration, and lies the template 10 flat on the ground. The first, second, and third vertical foot marker members 30, 32, 34 are pivotally unfolded away from the horizontal foot marker member 22 so as to rest in perpendicular relation thereto. Next, user inserts tees 74 through various selected holes 72 so as to secure the present invention to the ground. After utilizing the tee-receiving notch 62 to place the golf ball 15 in proper position, user folds the ball positioning member 60 atop the third vertical foot marker member 34 such that an upper surface of the ball positioning member 60 lies in a flush manner, flat against the upper surface of third vertical foot marker member 34. User then selects a golf club 50 of choice and determines the best feet position for such club 50. Finally, user documents ascertained coordinates and continues the aforementioned procedure for each selected golf club 50.

The use of the present invention allows a user to determine a point of reference for feet position, relative to fixed golf ball position and club choice for properly executing various golf shots.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A golf stance coordinator template comprising:

a foot positioning template, said foot positioning template having an E-shaped configuration for freely adjusting positioning of a user's feet formed by an elongated horizontal foot marker member terminating at two ends and includes horizontally disposed indicia displayed along an upper surface thereof and corresponding holes located directly below each of said indicia for insertion of anchoring means for holding said template in place during use and for marking current stance coordinates, a first end pivotally coupled to a first vertical foot marker member, an opposing second end pivotally coupled to a second vertical foot marker member, and a third vertical foot marker member pivotally coupled to said horizontal foot marker member intermediate to said first vertical foot marker member and said second vertical foot marker member and substantially aligned along a linearly elongated centerline of said horizontal foot marker member, said horizontal marker member aligned parallel to a target line formed between a golf ball and a target, wherein said first vertical foot marker member is pivotally coupled to a lower surface of said horizontal foot marker member and is extendable to a position parallel to said horizontal foot marker member;

a locking assembly coupling said horizontal marker member with said first vertical foot marker member, said second vertical foot marker member and said third vertical foot marker member, respectively; and a ball positioning member coupled to said third vertical foot marker member.

2. The golf stance coordinator template of claim 1, wherein second vertical foot marker member is pivotally coupled to a lower surface of said horizontal foot marker member and extendable to a position parallel to said horizontal foot marker member.

3. The golf stance coordinator template of claim 1, wherein said third vertical foot marker member is pivotally coupled to an upper surface of said horizontal foot marker member, and wherein said third vertical foot marker member is extendable perpendicular to said horizontal vertical foot marker member in a manner so as to traverse said horizontal foot marker member.

4. The golf stance coordinator template of claim 1, wherein said third vertical foot marker member has an upper end projecting outward, slightly beyond a width of said horizontal foot marker member, and wherein said third vertical foot marker member is designed with a shorter length with respect to said first and said second vertical foot marker members.

5. The golf stance coordinator template of claim 1, wherein said horizontal foot marker member has a hole provided directly below each one of said locking assembly for insertably receiving said anchoring means, thereby further securing said foot positioning template in place and marking coordinates of foot positioning in relation to indicia placed thereon.

6. The golf stance coordinator template of claim 5, wherein said locking assembly comprises a bolt, a washer, and a nut, and wherein said nut being torqued so as to allow for said first vertical foot marker member, said second vertical foot marker member, and said third vertical foot marker member to freely pivot about said horizontal foot marker member.

7. The golf stance coordinator template of claim 5, wherein said first vertical foot marker member, said second vertical foot marker member, and said third vertical foot marker member are designed and configured so as to pivotally collapse inward, in a direction towards said horizontal foot marker member, thereby facilitating said foot positioning template being foldable into an I-shaped configuration.

8. The golf stance coordinator template of claim 5, wherein said first vertical foot marker member and said second vertical foot marker member having vertically disposed indicia displayed along an upper surface thereof, wherein said vertically disposed indicia is represented as a series of letters beginning at a forward end of said first vertical foot marker member and said second vertical foot marker member.

9. The golf stance coordinator template of claim 8, wherein said series of letters start with "A" and end with "N", and wherein each letter of said series of letters having a hole provided directly thereabove for insertion of said anchoring means.

10. The golf stance coordinator template of claim 5, wherein said third vertical foot marker member has vertically disposed indicia displayed along an upper surface thereof, wherein said indicia is represented by a series of letters beginning at a forward end of said third vertical foot marker member.

11. The golf stance coordinator template of claim 10, wherein said series of letters start with "A" and end with "L", and wherein each letter of said series of letters having a hole provided directly thereabove for insertion of said anchoring means.

12. The golf stance coordinator template of claim 1, wherein said ball positioning member is attached via a hinge to an upper end of said third vertical foot marker member, said hinge allows for said ball positioning member to be folded atop said third vertical foot marker member in a flush manner, and wherein said ball positioning member defines an arcuate-shaped, tee-receiving notch at an end thereof for accommodating a golf tee.

13. The golf stance coordinator template of claim 12, wherein said ball positioning member has an aperture located adjacent to said hinge so as to allow passage by said locking assembly of said third vertical foot marker member upon said ball positioning member being folded atop said third vertical foot marker member.

14. The golf stance coordinator template of claim 1, wherein said indicia of said horizontal foot marker member is represented as a first series of numerals, said first series of numerals starting with "11" and descending in consecutive order to "1".

15. The golf stance coordinator template of claim 1, wherein said indicia of said horizontal foot marker member is further represented by a second series of numerals, said second series of numerals starting with "1" and increasing in consecutive order to "11".

16. A golf stance coordinator template comprising:

a foot positioning template, said foot positioning template having an E-shaped configuration for freely adjusting positioning of a user's feet formed by an elongated horizontal foot marker member terminating at two ends, a first end pivotally coupled to a first vertical foot marker member, an opposing second end pivotally coupled to a second vertical foot marker member, and a third vertical foot marker member pivotally coupled to said horizontal foot marker member intermediate to said first vertical foot marker member and said second vertical foot marker member and substantially aligned along a linearly elongated centerline of said horizontal foot marker member, said horizontal marker member aligned parallel to a target line formed between a golf ball and a target;

a locking assembly coupling said horizontal marker member with said first vertical foot marker member, said second vertical foot marker member and said third vertical foot marker member, respectively, and a ball positioning member coupled to said third vertical foot marker member, wherein said ball positioning member is attached via a hinge to an upper end of said third vertical foot marker member, said hinge allows for said ball positioning member to be folded atop said third vertical foot marker member in a flush manner, and wherein said ball positioning member defines an arcuate-shaped, tee-receiving notch at an end thereof for accommodating a golf tee, and wherein said ball positioning member is provided with indicia along a lower surface thereof, said indicia is represented as a series of letters, wherein said series of letters starting with "A" and ending with "C", and wherein each letter of said series of letters having a hole provided directly there above for insertion of anchoring means, and wherein said indicia is designed and configured such that when said ball positioning member is superimposed over said third vertical foot marker member, said indicia correspond in an identical manner with letters "A" through "C" of said third vertical foot marker member.

17. The golf stance coordinator template of claim 16, wherein said horizontal foot marker member further comprises horizontally disposed indicia displayed along an upper surface thereof and corresponding holes located directly below each of said indicia for insertion of anchoring means for holding said template in place during use and for marking current stance coordinates, wherein said horizontal foot marker member comprises a first series of numerical indicia and a second series of numerical indicia, said first series and said second series beginning at opposite termini of said horizontal foot marker member with the numeral "11" and descending to the numeral "1" in consecutive order.

18. The golf stance coordinator template of claim 16, wherein each of said first vertical foot marker member, said second vertical foot marker member and said third vertical foot marker member is pivotally coupled to a lower surface of said horizontal foot marker member and pivotal from a position parallel to said horizontal foot marker member to a position perpendicular to said horizontal foot marker member;

wherein positioning said first vertical foot marker member, said second vertical foot marker member and said third vertical foot marker member in a position parallel to said horizontal foot marker member facilitates arrangement of said template into an I-shaped configuration for convenient storage and transport.

19. The golf stance coordinator template of claim 16, wherein each one of said first vertical foot marker member, said second vertical foot marker member and said third vertical foot marker member comprises vertically disposed indicia represented as a series of letters beginning at a forward end of said first vertical foot marker member, said second vertical foot marker member and said third vertical foot marker member, wherein said series of letters of said first vertical foot marker member and said second vertical foot marker member begins with "A" and concludes with "N", and wherein said series of letters of said third vertical foot marker member begins with "A" and concludes with "L", and wherein a corresponding hole is provided directly above each letter within said series of letters for insertion of said anchoring means.

* * * * *